US007857149B2

(12) United States Patent
Cummins

(10) Patent No.: US 7,857,149 B2
(45) Date of Patent: Dec. 28, 2010

(54) GUN STORAGE CAROUSEL

(76) Inventor: Mark K. Cummins, 553 Guadalupe Dr., Allen, TX (US) 75002

( * ) Notice: Subject to any disclaimer, the term of this patent is extended or adjusted under 35 U.S.C. 154(b) by 0 days.

(21) Appl. No.: 10/752,305

(22) Filed: Jan. 6, 2004

(65) Prior Publication Data

US 2004/0164036 A1 Aug. 26, 2004

Related U.S. Application Data

(60) Provisional application No. 60/438,458, filed on Jan. 7, 2003.

(51) Int. Cl.
*A47F 3/10* (2006.01)

(52) U.S. Cl. ..... 211/64; 211/60.1; 211/70; 211/70.8

(58) Field of Classification Search ..... 211/64, 211/70, 163, 205, 1.53, 53, 60.1, 70.8, 205.1, 211/68, 70.5; 312/249.3, 280, 135, 125, 312/197, 246, 305, 34.2; 248/512; D6/457; 206/249.3, 135, 280; 222/144
See application file for complete search history.

(56) References Cited

U.S. PATENT DOCUMENTS

| | | | | | |
|---|---|---|---|---|---|
| 405,335 | A | * | 6/1889 | Amerine | 211/64 |
| 492,304 | A | * | 2/1893 | Markle | 312/135 |
| 505,320 | A | * | 9/1893 | Meadows | 211/64 |
| 712,428 | A | * | 10/1902 | Whitcomb | 211/64 |
| 791,101 | A | * | 5/1905 | Klein | 312/135 |
| 945,223 | A | * | 1/1910 | Cofield | 211/70 |
| 1,101,849 | A | * | 6/1914 | Hines | 108/95 |
| 1,586,827 | A | * | 6/1926 | Michelbach | 211/70 |
| 1,761,088 | A | * | 6/1930 | Pryde | 211/68 |
| 1,929,677 | A | * | 10/1933 | Davis | 312/202 |
| 1,956,490 | A | * | 4/1934 | Cannon | 211/163 |
| 1,970,655 | A | * | 8/1934 | Iriarte | 312/249.3 |
| 1,983,167 | A | * | 12/1934 | Chisolm | 211/44 |
| 2,326,064 | A | * | 8/1943 | Pittman | 312/305 |
| 2,376,955 | A | * | 5/1945 | Ball | 211/60.1 |
| 2,574,164 | A | * | 11/1951 | Baay | 362/127 |
| 3,826,378 | A | * | 7/1974 | Novak | 211/70.5 |
| 3,847,285 | A | * | 11/1974 | Leprince | 211/1.53 |
| 3,927,923 | A | * | 12/1975 | Kimmel | 312/125 |
| 4,099,808 | A | * | 7/1978 | Oakley et al. | 312/297 |
| 4,222,490 | A | * | 9/1980 | Wood, Jr. | 211/70.5 |
| D263,780 | S | * | 4/1982 | Hildebrand et al. | D6/457 |
| 4,688,685 | A | * | 8/1987 | Brace | 211/70.5 |
| 4,753,446 | A | * | 6/1988 | Mills | 280/47.18 |
| 4,838,625 | A | * | 6/1989 | Taylor | 312/249.5 |
| 5,137,319 | A | * | 8/1992 | Sauder | 294/159 |
| D335,595 | S | * | 5/1993 | Bowen | D6/472 |

(Continued)

*Primary Examiner*—Katherine W Mitchell
*Assistant Examiner*—Colleen M Quinn
(74) *Attorney, Agent, or Firm*—Gardere Wynne Sewell, LLP

(57) ABSTRACT

A gun carousel 100 including a main post 102 secured to a base 104, a center wing 106 secured to the middle portion of main post 102, and a top cabinet 108 secured to the upper end of main post 102. The base 104 incorporates slots 110 for receiving rifle butts, while the center wing 106 incorporates a set of cutouts 112 for receiving rifle upper portions. Top cabinet 108 has a top panel 114, a bottom panel 116, side panels 118, and doors 120 secured by hinges 122. Doors 120 may incorporate inserts 124 having images thereon. Bottom panel 116 connects to main post 102 through a flange 126.

18 Claims, 6 Drawing Sheets

U.S. PATENT DOCUMENTS

D341,276 S * 11/1993 Jones ..... D6/457
D379,881 S * 6/1997 Gregg et al. ..... D6/457
5,676,261 A * 10/1997 Baughman et al. ..... 211/70
D394,575 S * 5/1998 Mikloczak et al. ..... D6/552
6,308,838 B1 * 10/2001 Endean ..... 211/37
7,559,428 B2 * 7/2009 Matzick ..... 211/64

* cited by examiner

GUN STORAGE CAROUSEL

CROSS REFERENCE TO RELATED APPLICATION

This application claims priority from provisional patent application Ser. No. 60/438,458 filed on Jan. 7, 2003.

TECHNICAL FIELD OF THE INVENTION

The present invention relates to storage of long firearms. Specifically, the present invention relates to a gun storage carousel.

BACKGROUND

Persons enjoying sporting activities such as hunting and fishing have a need for a convenient place to store their gear. It is desirable that such storage space be sturdy and reliable. It is also desirable to be able to store all of one's equipment in a single place. Hunting enthusiasts and gun collectors usually have a very sizable investment in the rifles, shotguns and pistols in their collections. However, most home-owners do not have a suitable place to store expensive firearms where they are secure against thieves and inaccessible to children. Thus the need exists for a cabinet suitable for use in the home and where guns or other valuables can be securely stored.

A large number of gun owners store their prized firearms in a gun safe. The typical safe consists of an upright steel box that has a hinged door on the front. On the inside, the safe has a liner that is notched to support the rifles and shotguns. Handguns and accessories can be placed on shelves above the long guns and on the door. While this type of safe provides the most secure way to store guns, the way that the liner is designed makes it difficult to insert or remove the long guns. This may force the owner to remove one or more guns before he can remove the gun that he wants. Removing extra guns is inconvenient, and there is a chance of bumping the guns together.

SUMMARY OF THE INVENTION

The present invention is a rotating stand that provides a safe, convenient way to store firearms. The present invention consists of a carousel that could be placed in a gun safe or directly on a floor or table. The carousel may be mounted on a base reinforced by crossmembers. A post secured to the center of the base accepts a cylindrical bearing collar that is mounted on the bottom of a round disk forming the bottom of the carousel. The base features recesses along each side of the carousel to hold the butt end of gun stocks. The disk may be fitted with a round wood or plastic overlay that is recessed to hold the butt of 12 rifles or shotguns. The recesses may be arranged in four sets and could be lined with felt, carpeting or a similar material so that the guns are not scratched.

The upright post holds a structure that is notched to support the barrels of the guns. The structure may have a hole in the center to fit around the upright post, and the upright post may incorporate features so that the structure could be, adjusted to the desired height and secured. The notches on the structure may be arranged in four groups with notches in each group. Flat shelves 107 or other features may be mounted on the center upright post to provide storage space for small items.

The top of the upright post may be fitted with a cylindrical storage container. A set of one or more doors may be spaced around the perimeter of the storage area to provide access to small compartments that may hold handguns, ammunition, cleaning supplies, etc. The storage area may be produced from wood, and various game animals and birds may be laser carved into the surface for an attractive appearance. A sculpture of a deer or another animal could also be mounted on top of the storage area to enhance the appearance. In addition, lights may be mounted on the underside of the storage area to illuminate the firearms.

The present invention may be incorporated into the production of a gun safe produced in the conventional manner. The safe could be offered with or without fireproof insulation and with various options such as different locks and handles. The exterior could also be offered in various colors. The present invention could be sold separately for installation in an existing safe or for use as a freestanding floor or tabletop display.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE DRAWINGS

While the making and using of various embodiments of the present invention are discussed in detail below with reference to certain contexts, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

The present invention is designed to provide a convenient new insert that may be placed in a gun safe to save time and increase the owner's convenience. The invention consists of a rotating stand that can hold the rifles and shotguns upright. The top support may be vertically adjustable to hold guns with long or short barrels, and the notches may be arranged to maximize the storage space. The notch configuration keeps the guns apart so that each gun may be quick and easy to remove. The rotating action may also allow the owner to turn the stand so that the gun that he wants is in the front and can be removed easily. This may be considerably quicker and easier than removing a couple guns before the desired one can be removed. Eliminating the need to remove a few guns may also reduce the chances of bumping the guns together. In addition, eliminating the need to handle multiple guns may eliminate the need to wipe the guns off with oil so that they do not rust. Naturally, the rotating action may also make it easier to insert a gun.

Figure 4:
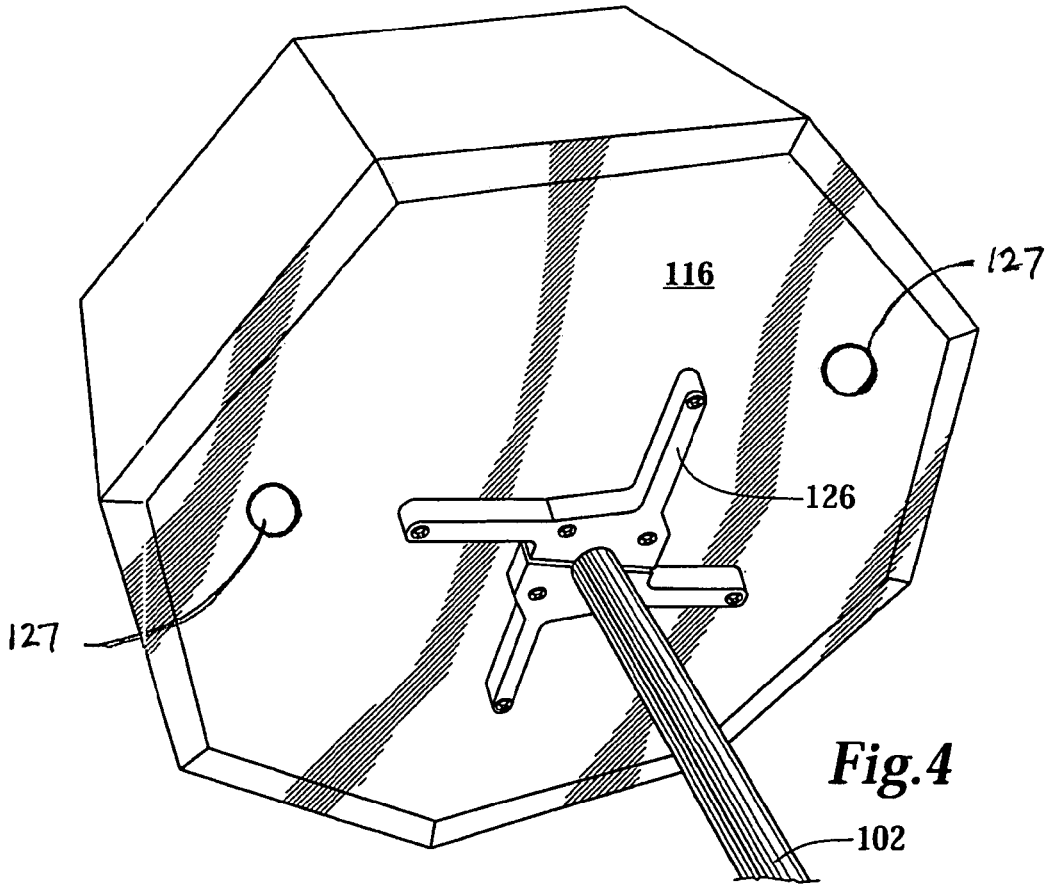
FIG. 4 is a bottom view of the top cabinet of FIG. 2.

The rotating carousel may also include a cylindrical top compartment that may provide space for storing handguns, ammunition, and accessories. The compartment may include folding doors that may allow quick, easy access. The doors may be adorned with carved game animals and birds for an attractive appearance. Lights 127 could also be included on the bottom of the compartment to illuminate the long guns as shown in FIG. 4. In addition, a sculpture of a game animal or bird could be mounted on the top of the compartment to further enhance the appearance.

The present invention could be offered with a new gun safe or sold separately for installation in an existing safe. As with existing safes, new safes including this feature could be offered with various options and in different price ranges to meet the needs and fit the budget of all buyers. The aftermarket model may appeal to a gun owner who already has a safe but is not satisfied with the existing liner. Since the shelves and supports in most safes are easy to remove, it may be a simple matter to remove the existing liner and install the present invention. If desired, the rotating stand could also be bolted to the floor of the safe for additional security. In addition, the present invention could also be placed on the floor or on a table and used to openly display long guns. This may allow a gun owner to show off his guns when he has company in his home. A gun shop or a gun dealer at a show could also use the present invention as a freestanding display.

The present invention is designed to provide a gun owner or dealer with a safe, convenient way to store firearms. The product may consist of a rotating carousel that could be placed in a gun safe or used alone as a freestanding unit. The carousel may have a recessed disk on the bottom to hold the end of the butt stock and a movable top disk that may be notched hold the barrel. The butt stock recesses and barrel notches may be arranged to hold up to 12 rifles and/or shotguns. The rotating design may allow the carousel to be turned until the desired gun is in the front and could be inserted or removed easily. This may eliminate the need to waste time and effort removing a couple guns. The chances of bumping the guns together while inserting or removing one may also be reduced.

The present invention may be installed as a replacement for the existing liner in a gun safe. The carousel could be included with a new safe or sold separately so that a buyer could replace the liner in a safe that he already owns. If desired, the freestanding model could also be placed on the floor or on a table to display firearms at home, in a gun shop, or at a gun show.

The upright that forms the center post of the carousel may also include a cylindrical storage container and a set of optional shelves. The storage container may be mounted on the top of the upright and could include a set of hinged access doors. The doors could be adorned by carvings of game birds and animals. A small figure of a game bird or animal could also be mounted on the top to enhance the decorative appearance. In addition, lights could be mounted on the bottom of the storage container to illuminate the long guns.

Figure 1A:
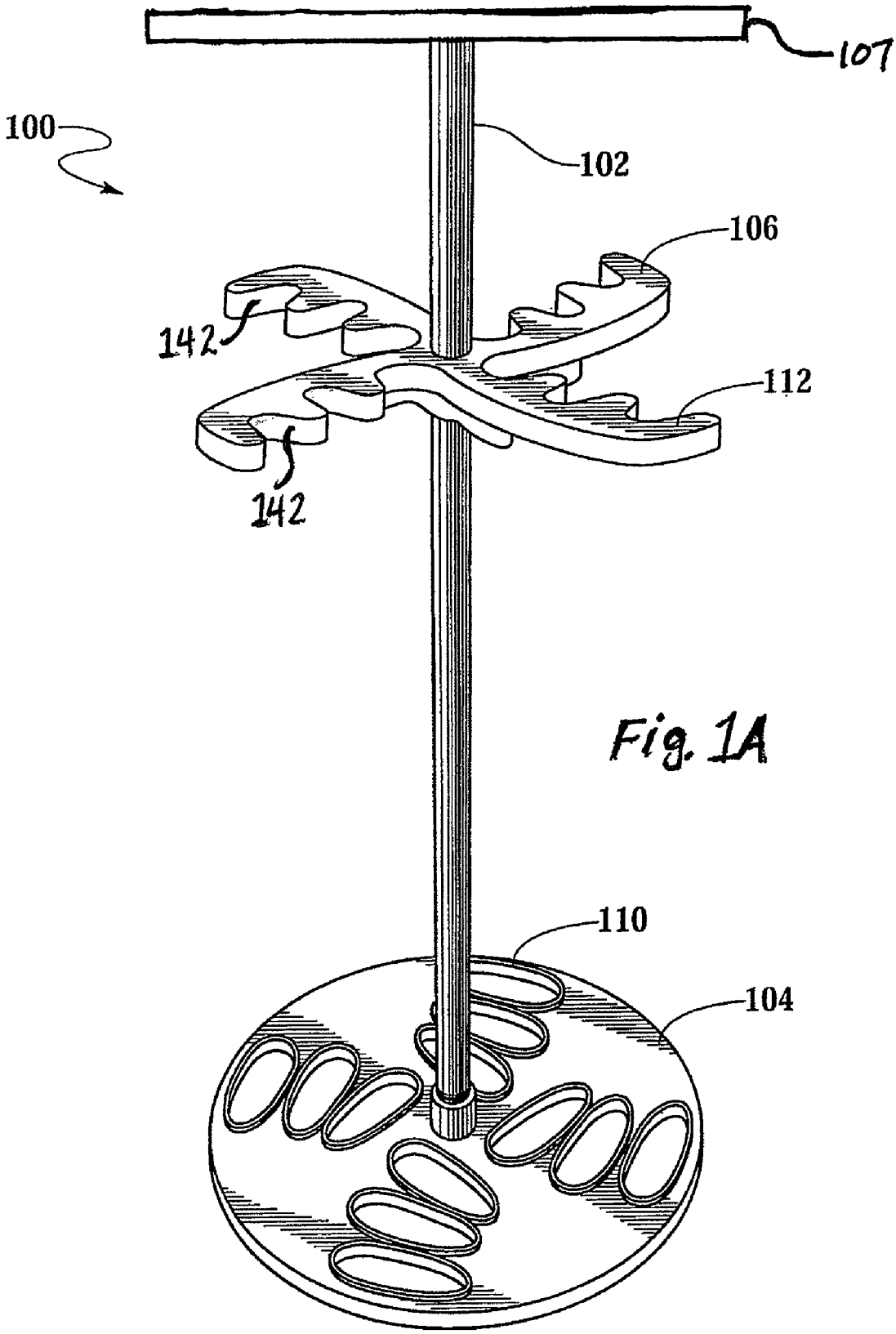
FIG. 1 includes FIGS. 1A and 1B both depicting a three-dimensional view of a gun carousel according to embodiments of the present invention.
Figure 1B:
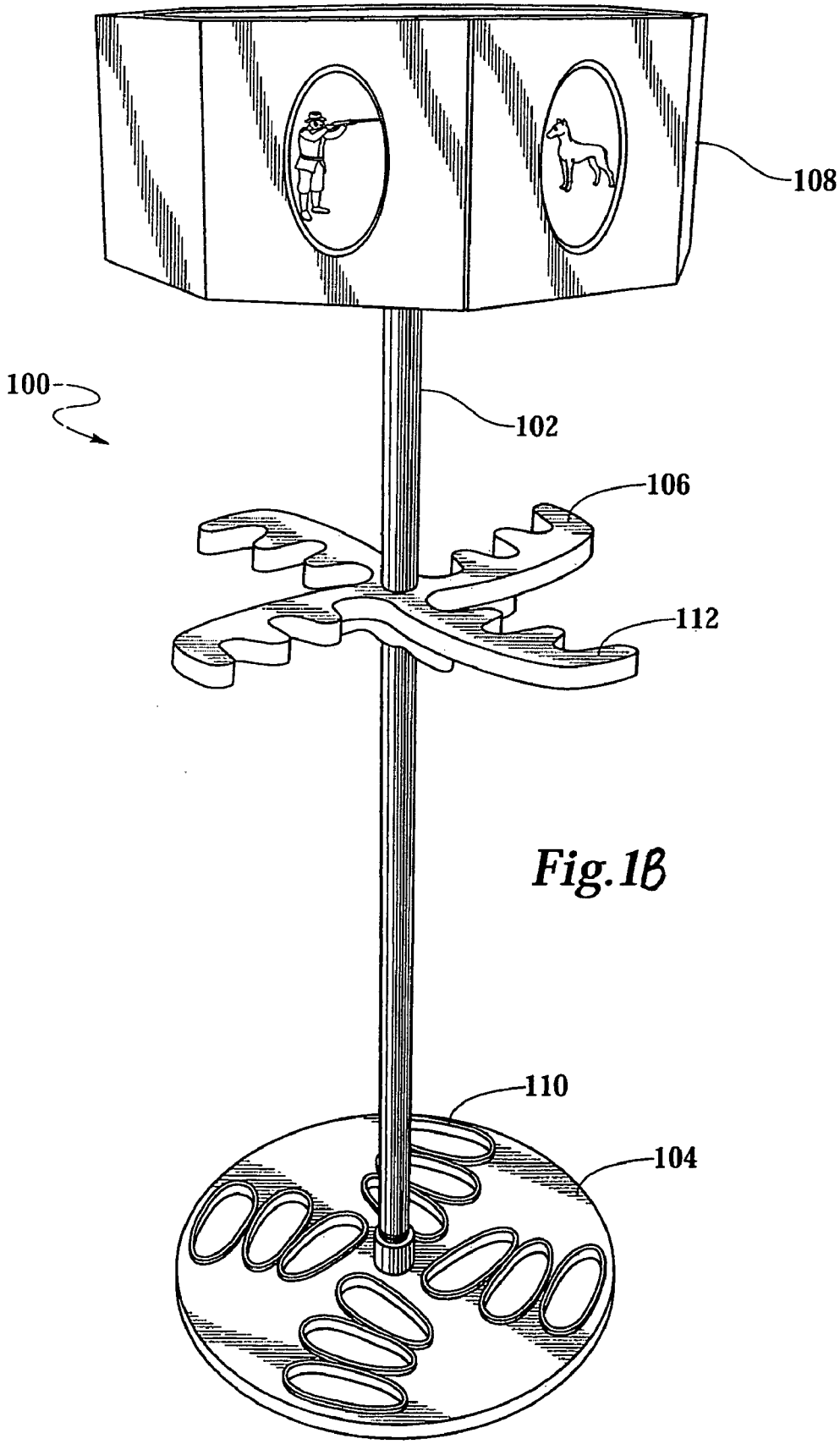

FIGS. 1A and 1B are three-dimensional views of a gun carousel according to embodiments of the present invention. Gun carousel 100 includes a main post 102 secured to a base 104, a center wing 106 secured to the middle portion of main post 102, and a top cabinet 108 secured to the upper end of main post 102. The base 104 incorporates slots 110 for receiving rifle butts (not shown), while the center wing 106 incorporates cutouts 112 with interior surfaces 142 for receiving rifle upper portions (not shown).

Figure 2:
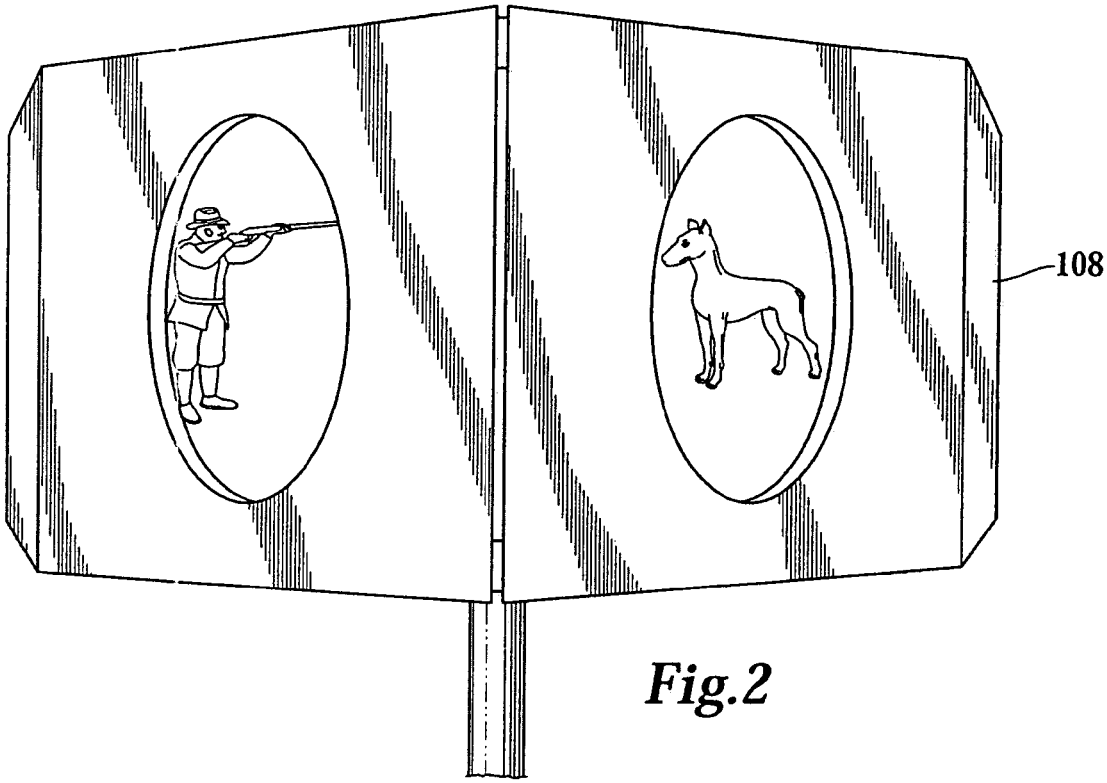
FIG. 2 is a three-dimensional view of a top cabinet of the gun carousel of FIG. 1B.
Figure 3:
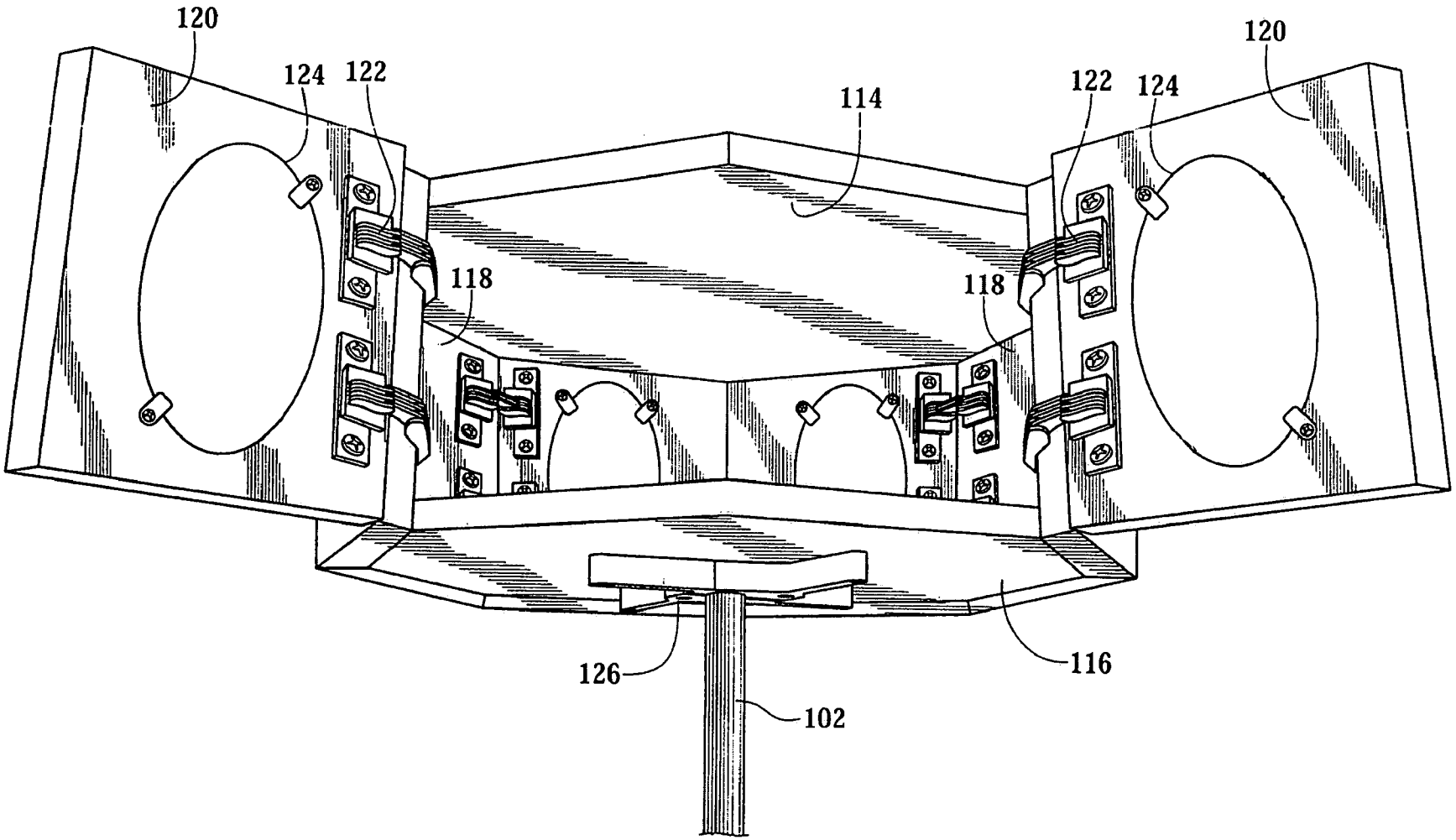
FIG. 3 is a three-dimensional interior view of the top cabinet of FIG. 1B.

FIG. 2 is a three-dimensional view of a top cabinet of the gun carousel of FIG. 1B FIG. 3 is a three-dimensional interior view of the top cabinet of FIG. 2. FIG. 4 is a bottom view of the top cabinet of FIG. 2. Top cabinet 108 has a generally-octagonal shape, though other shapes will be known to those of skill in the art. Top cabinet 108 has a top panel 114, a bottom panel 116, side panels 118, and doors 120 secured by hinges 122. Doors 120 incorporate inserts 124 having images thereon. Bottom panel 116 connects to main post 102 through a flange 126.

Figure 5:
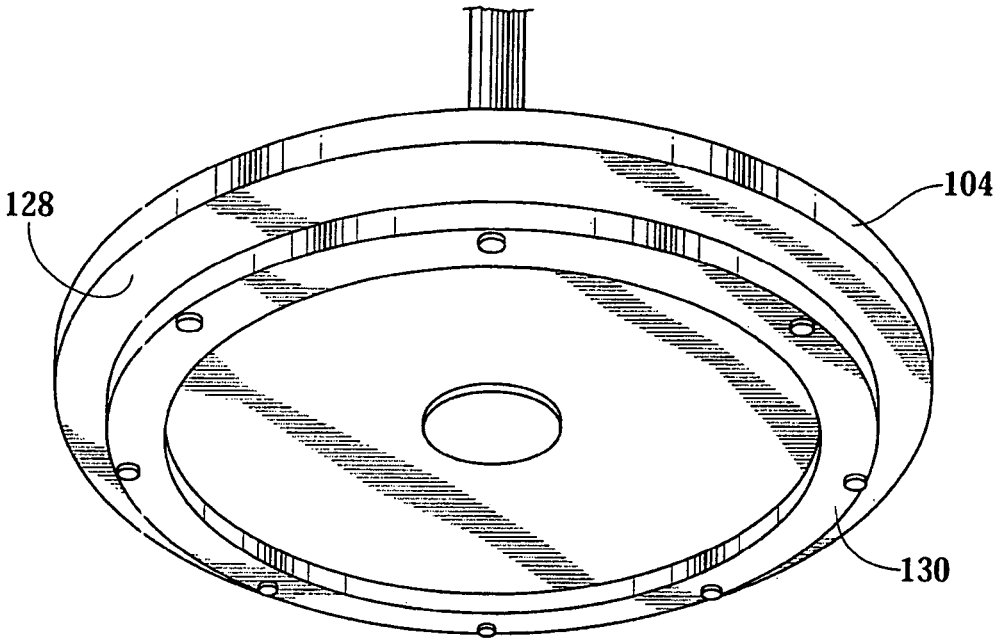
FIG. 5 is a bottom view of the base of the gun carousel of FIG. 1.
Figure 6:
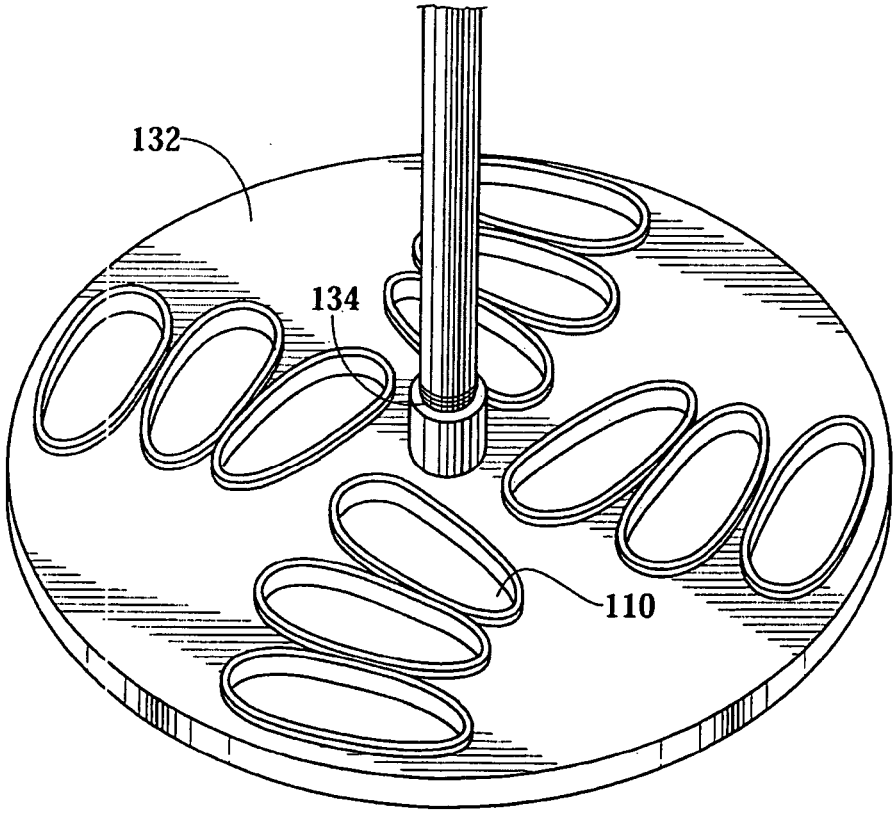
FIG. 6 is a top view of the base of FIG. 5.

FIG. 5 is a bottom view of the base of the gun carousel of FIG. 1. FIG. 6 is a top view of the base of FIG. 5. Base 104 includes a lower disc portion 128 having a bearing 130 connected thereto, to allow for rotation of the gun carousel 100. Base 104 also includes an upper disc portion 132 having slots cut therein, so as to receive the butts of rifles disposed in the carousel 100. Base 104 is connected to main post 102 by a threaded connection 134.

Figure 7:
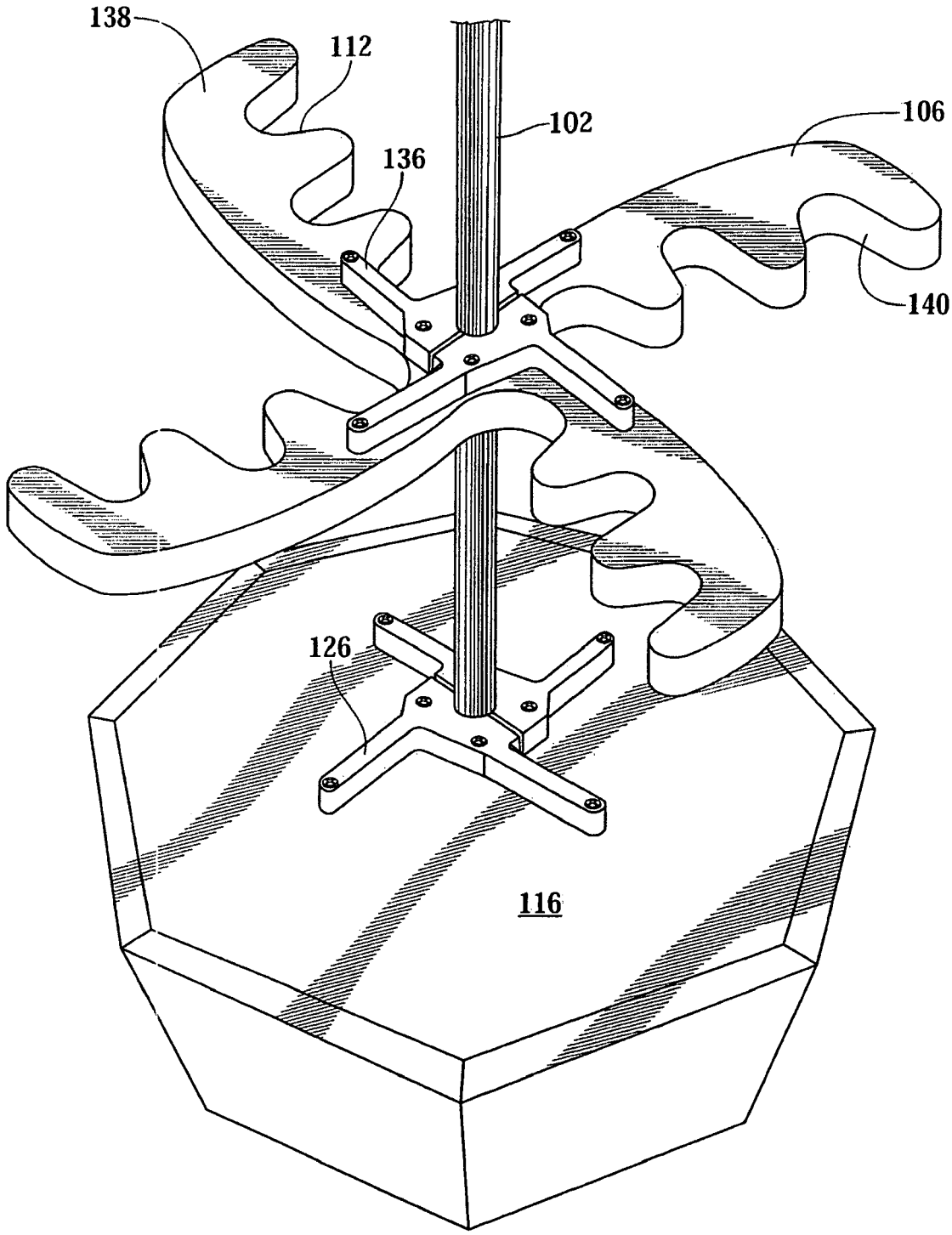
FIG. 7 is a bottom view of the center wing assembly of the gun carousel of FIG. 1B.

FIG. 7 is a bottom view of the center wing assembly 106 of the gun carousel 100 of FIG. 1B. Center wing assembly 106 is secured to main post 102 by a flange 136. Center wing assembly 106 has four arms 138, each having cutouts 140 for receiving the upper portions of rifles (not shown) disposed in the gun carousel 100.

Whereas the invention has been shown and described in connection with the preferred embodiment thereof, it will be understood that many modifications, substitutions and additions may be made which are within the intended broad scope of the invention described herein. There has therefore been shown and described an improved gun carousel which accomplishes a number of advantages.

The invention claimed is:

1. A freestanding gun storage carousel for storing plural guns, said carousel being adapted to be disposed in a gun safe, said carousel comprising;

a generally ring-shaped bearing member operable to be disposed on a support surface and coupled to and-extending from a bottom surface of a cylindrical disc base, the bearing supporting the carousel upright on a surface;

the cylindrical disc base supported on and rotatable with respect to said bearing member, said base including an upward facing disc surface portion and plural slots formed spaced apart in said surface portion for receiving respective gun butts;

an elongated vertically extending post secured at one end to said base, without being directly connected to the bearing member, for rotation with said base, the post not requiring bracing at any point between the end secured to said base and a top terminal end of the post opposite said base in order to maintain the post in a vertical orientation when placed on the base, the post being supported only by the bearing and the base;

a vertically movable gun support assembly secured to said post spaced from and above said base and including plural, radially extending, circumferentially spaced apart arms, each of said arms including plural cutout portions vertically aligned with respective ones of said slots for receiving a portion of a gun in supportive relationship, and arranged along one side of the radially extending arm, said support assembly being secured to said post for rotation herewith, wherein the plural cutout portions each include an interior surface, against which a gun upper portion would rest and an innermost portion of the interior surface is offset, in a direction lateral to a radius extending along the arm, and a storage container unit comprising a cabinet including spaced apart top and bottom panels, plural side panels and plural hinged doors providing access to storage space substantially independent of a rotative position of said storage container unit and independent of the presence of one or more guns supported on said carousel, the bottom panel of the container unit being connected to the top terminal end of the post.

2. The gun carousel set forth in claim 1 wherein:

said storage container unit is connected to said post by a flange secured to said post and to said bottom panel.

3. The gun carousel set forth in claim 1 wherein:

said gun support assembly is secured to said post by a flange secured to said arms and to said post.

4. The gun carousel set forth in claim 1 wherein:

said post is secured to said base by a threaded connection.

5. The gun carousel set forth in claim 1 wherein:

said gun support assembly is secured to a middle portion of said post between said ends.

6. A freestanding gun storage carousel for storing plural guns comprising at least one of rifles and shotguns, said carousel being adapted to be disposed in a gun safe, said carousel comprising;

a generally ring shaped bearing member operable to be disposed on a support surface and coupled to and extending from a bottom surface of a cylindrical disc base, the bearing supporting the carousel upright on a surface;

the cylindrical disc base supported on and rotatable with respect to said bearing member, said base including a downward facing disc surface portion engaged with said bearing member, an upward facing disc surface portion and plural slots formed spaced apart in said upward facing disc surface portion for receiving respective gun butts;

an elongated vertically extending post secured by a threaded connection at one end to said base for rotation with the base, the post not requiring bracing at any point between the end secured to said base and an end of the post opposite said base in order to maintain the post in a vertical orientation when placed on the base, the post being supported only by the base and bearing;

a vertically movable gun support assembly secured to a middle portion of said post spaced from and above said base and including plural radially extending circumferentially spaced apart arms, each of said arms including plural cutout portions vertically aligned with respective ones of said slots and arranged along the radially extending arm for receiving a portion of a gun in supportive relationship, said support assembly being secured to said post for rotation therewith; and a storage container unit secured to an opposite end of said post above said support assembly for rotation with said post and comprising a cabinet including spaced apart top and bottom panels, plural side panels and plural hinged doors providing access to a storage space substantially independent of a rotative position of said storage container unit and independent of the presence of one or more guns supported on said carousel.

7. The gun carousel set forth in claim 6 wherein:

said storage container unit is connected to said post by a flange secured to said post and to said bottom panel.

8. The gun carousel set forth in claim 6 wherein:

said gun support assembly is secured to said post by a flange secured to said arms and to said post.

9. A freestanding gun storage carousel for storing plural rifles and shotguns, said carousel being adapted to be disposed in a gun safe, said carousel comprising;

a generally ring shaped bearing member operable to be disposed on a support surface and coupled to and extending from a bottom surface of a cylindrical disc base, the bearing supporting the carousel upright on a surface;

the cylindrical disc base supported on and rotatable with respect to said bearing member, said base including an upward facing disc surface portion and plural slots formed spaced apart in plural radially extending rows in said surface portion for receiving respective gun butts;

an elongated vertically extending post secured at one end to a center of said base for rotation with said base, the post not requiring bracing at any point between the end secured to said base and an end of the post opposite said base in order to maintain the post in a vertical orientation when placed on the base, the post being supported only by the bearing and the base;

a vertically movable gun support assembly secured to a middle portion of said post spaced from and above said base and including plural, radially extending, circumferentially spaced apart arms, each of said arms including plural cutout portions vertically aligned with respective ones of said slots and arranged along one side of the radially extending arm for receiving a portion of a rifle or shotgun in supportive relationship, said support assembly being secured to said post for rotation therewith by a flange secured to said arms and to said post; and a storage container unit secured to an opposite end of said post above said support assembly for rotation with said post and comprising a cabinet including spaced apart top and bottom panels, plural side panels and plural hinged doors providing access to a storage space substantially independent of a rotative position of said storage container unit and independent of the presence of one or more rifles or shotguns supported on said carousel, and said storage container unit is connected to said post by a flange secured to said post and to said bottom panel.

10. The gun carousel set forth in claim 9 wherein:

said post is secured to said base by a threaded connection.

11. The gun carousel set forth in 1 wherein:

the post includes a storage space secured above said support assembly for rotation with said post and disposed for access to store and retrieve articles independent of guns being stored in said carousel.

12. The gun carousel set forth in 1 wherein:

the storage container is polygonal.

13. The gun carousel set forth in 1 wherein:

the storage container comprises one or more doors.

14. The gun carousel set forth in claim 1 wherein:

the storage container includes lights for illumination of the guns.

15. The gun carousel set forth in claim 1 wherein:

flat shelves may be mounted on the post.

16. The gun carousel set forth in claim 1 wherein:

the post is capable of being mounted to the support surface.

17. The gun carousel set forth in claim 1 wherein:

the plural slots of the base are recessed.

18. The gun carousel set forth in claim 1 wherein:

the plural slots of the base and the cutout portions of the support assembly are arranged in four groups.

* * * * *